US007339472B2

(12) United States Patent
Pierson et al.

(10) Patent No.: US 7,339,472 B2
(45) Date of Patent: Mar. 4, 2008

(54) SELF-ADJUSTING CAM ASSEMBLY

(75) Inventors: Josh Pierson, Golden, CO (US); Gilbert Lombardo, San Marcos, TX (US)

(73) Assignee: Detex Corporation, New Braunfels, TX (US)

( * ) Notice: Subject to any disclaimer, the term of this patent is extended or adjusted under 35 U.S.C. 154(b) by 158 days.

(21) Appl. No.: 11/098,867

(22) Filed: Apr. 5, 2005

(65) Prior Publication Data

US 2005/0231363 A1 Oct. 20, 2005

Related U.S. Application Data

(60) Provisional application No. 60/560,809, filed on Apr. 8, 2004, provisional application No. 60/560,651, filed on Apr. 8, 2004.

(51) Int. Cl.
*E05B 45/06* (2006.01)

(52) U.S. Cl. ..... 340/542; 70/432; 70/DIG. 49

(58) Field of Classification Search ..... 340/542; 70/101, 336, 357, 416, 432, DIG. 49
See application file for complete search history.

(56) References Cited

U.S. PATENT DOCUMENTS

| | | | | |
|---|---|---|---|---|
| 1,629,172 | A | | 5/1927 | Murphy |
| 1,838,333 | A | | 12/1931 | Stone |
| 3,026,385 | A | | 3/1962 | Davis et al. |
| 3,089,329 | A | | 5/1963 | Kerr |
| 3,382,688 | A | | 5/1968 | Wellekens |
| 3,503,233 | A | | 3/1970 | Russell et al. |
| 3,724,244 | A | | 4/1973 | Schaumberg |
| 3,899,907 | A | | 8/1975 | Prahl |
| 4,077,240 | A | | 3/1978 | Crasnianski |
| 4,196,605 | A | | 4/1980 | Garza |
| 4,297,862 | A | | 11/1981 | Solovieff |
| 4,359,886 | A | | 11/1982 | Evans et al. |
| 4,522,048 | A | | 6/1985 | Davis |
| 4,573,334 | A | | 3/1986 | Crepinsek |
| 4,581,909 | A | | 4/1986 | Weber |
| 4,624,120 | A | * | 11/1986 | Hoffman et al. ..... 70/DIG. 49 |
| 4,679,418 | A | | 7/1987 | Allen |
| 4,759,204 | A | | 7/1988 | Neyret |
| 4,763,937 | A | | 8/1988 | Sittnick, Jr. et al. |
| 4,930,822 | A | | 6/1990 | Shen |
| 5,042,851 | A | | 8/1991 | Hunt |
| 5,265,453 | A | | 11/1993 | Konil et al. |
| 5,335,520 | A | | 8/1994 | Lee |
| 5,901,992 | A | | 5/1999 | Winkler |
| 5,988,708 | A | | 11/1999 | Frolov et al. |
| 6,104,594 | A | | 8/2000 | Frolov et al. |

(Continued)

*Primary Examiner*—Thomas Mullen
(74) *Attorney, Agent, or Firm*—John G. Fischer; Storm LLP

(57) ABSTRACT

An alarm assembly is adapted for ease of assembly. A mortise cylinder has an exterior end and an interior end. The mortise cylinder has a tailpiece on the interior end and is rotatable about an axis. A cam engages the tailpiece on the mortise cylinder to provide selective movement of the cam responsive to rotation of the mortise cylinder. A housing secures the mortise cylinder and cam relative to one another and to a wall or door. A biasing member is disposed between the housing and cam for urging the cam into engagement with the tailpiece of the mortise cylinder, wherein variations in the length of the mortise cylinder can be accommodated.

12 Claims, 4 Drawing Sheets

U.S. PATENT DOCUMENTS 6,223,567 B1 * 5/2001 Fadul ..... 70/149
6,502,436 B2 1/2003 Beatty
2002/0026817 A1 3/2002 Greer

* cited by examiner

SELF-ADJUSTING CAM ASSEMBLY

CLAIM OF PRIORITY

This application claims priority to U.S. Provisional Patent Application No. 60/560,809 filed on behalf of Josh Pierson and Gilbert Lombardo, entitled "Self-Adjusting Cam Assembly," filed on Apr. 8, 2004, and which is hereby incorporated by reference for all purposes.

CROSS-REFERENCES TO RELATED APPLICATIONS

This application is also related to co-pending U.S. patent application entitled "Retaining Mechanism for Mortise Cylinders," filed concurrently herewith, which claims priority to U.S. Provisional Patent Application No. 60/560,651, filed on Apr. 8, 2004.

FIELD OF THE INVENTION

The present invention relates generally to lock assemblies and alarm mechanisms in which a keyed or mortise cylinder is employed. More particularly, the present invention relates to a novel assembly for securing a mortise cylinder in an alarm housing.

BACKGROUND OF THE INVENTION

Commonly, door locks, exit alarms, panic devices, and other locking systems employ mortise cylinders that typically are operated with a key placed in a rotatable key cylinder portion of the mortise cylinder. Such assemblies often are installed on a wall or a door. To minimize the size, lock and alarm assemblies must be compact. This introduces a number of difficulties in the design and assembly of such devices.

Typically, an alarm or lock assembly comprises a plate (or cover) that covers the alarm or lock and the mortise cylinder disposed therein. A bracket is secured to the interior of the plate. The bracket and plate cooperate to form a housing for the mortise cylinder and alarm. Typical mounting of the housing is achieved with mounting screws. The mortise cylinder is commonly secured to the bracket by a hexagonal nut engaging threads formed on the exterior of the mortise cylinder. Keys and corresponding key ways, as well as set screws, are methods of securing the mortise cylinder to the housing to prevent rotation of the mortise cylinder.

During assembly of the alarm, the mortise cylinder and associated cam must be carefully positioned relative to one another in the housing to insure proper engagement between the mortise cylinder and cam. Therefore, reliable operation can be difficult to achieve with the alarm assemblies due to the complex installation configuration.

Additionally, there are varieties of mortise cylinder lengths that are in common use. Specifically, there are 5, 6, and 7 pin mortise cylinders that have different lengths. Therefore, depending on the length of the cylinder, adjustments are made during assembly. These adjustments may require a substantial amount of labor and expertise.

To avoid some of these problems, numerous attempts have been made to address the shortcomings of conventional locks and alarms. Some examples of these attempts are listed and discussed below.

U.S. Pat. No. 5,335,520 issued to Lee ("Lee"), discloses a flat lock system that will not be easily picked, in particular where the tumbler is not permitted to pivot with respect to the cylinder. It consists of a cylinder, a tumbler, and several rings and springs. The cylinder has an inner surface formed with a number of separate ribs defining passages that extend perpendicular to the length of the cylinder. The tumbler consists of a disk defining a keyhole, and it is integrated with a key receiver and a latch carrier. The rings and springs are alternatively mounted on the key receiver. Each ring has an outer rim with a number of ears and an inner rim with a number of arms. The purpose of the springs is to bias the rings towards the disk such that the ears protruding from the rings are trapped in the passages between the ribs. When a key is inserted in the key receiver, shoulders formed on the key push the arms on the rings such that the ears protruding from the rings align with the passages formed between the ribs to make the tumbler and latch pivotable.

U.S. Pat. No. 5,265,453 issued to Konii et al. ("Konii"), discloses a tamper and damage resistant cylinder lock. The lock comprising an axial cam provided on a key cylinder, a rotator for engagement with a sleeve and in contact with the axial cam, a stopper positioned adjacent to the rotator having a pair of lugs engageable with a recess of the casing, and an axial spring positioned between the stopper and a connector for resiliently urging the stopper toward the rotator. The rotator and stopper are axially moved by the axial cam to disengage the rotator from the sleeve and the stopper from the casing upon independent rotation of the sleeve on insertion of the correct key. The key cylinder, the rotator, the stopper and connector are rotated as a unit to a locked or unlocked position.

U.S. Pat. No. 4,759,204 issued to Neyret ("Neyret"), discloses a lock mechanism designed to improve security, especially against forceful rotation. It consists of a housing with a bore, a sleeve within the bore, and a rotor which is rotatably mounted and axially slidable within the sleeve. The rotor has a longitudinally extending key slot. A piston slides axially within the bore in the sleeve and rotor between a first rest position where the sleeve and rotor are coupled together for simultaneous rotation, and a second disengagement position resulting on insertion of appropriate key where said sleeve and rotor are uncoupled. Upon removal of the key, a spring pushes back the piston and the rotor towards the rest position.

U.S. Pat. No. 4,581,909 issued to Weber ("Weber"), discloses a cylinder lock, particularly a steering-wheel lock for a motor vehicle. It comprises a locking disk that is displaceable parallel to itself, axially movable on a projection of a cylinder core, and which is at right angles to the axis of the lock. The locking disk can be mounted very securely as it needs only make a sliding movement in relation to the cylinder core, and does not need to turn relative to the cylinder core. Thus, the 'ready-to-lock-position' of a locking or transmission member is not cancelled by a tilting or turning of the locking disk, but solely by movement in the axial direction. Moreover, the cylinder lock is connected to a cam that forms a bearing surface for the locking disk. A conical coil compression spring disposed upon an axial extension of the cylinder core urges the locking disk in the direction of the cam upon insertion of appropriate key.

U.S. Pat. No. 4,573,334 issued to Crepinsek ("Crepinsek"), discloses a deadbolt lock adjustable for mounting in doors of various thicknesses. It is an improvement of the deadlock of the type which is mounted in a door and has a lock body with a bore that provides secure access to the dead-bolt throw or retract mechanism. The improvement comprises coupling means non-adjustably and non-rotatingly mounted within the bore of the lock body and extending a preselected distance beyond the outer boundary of the bore, just sufficient to accommodate the thickness of a particular door. One disadvantage of Crepinsek, however, is that there is no system that self-adjusts to a range of depths, depending on the thickness of the door. Hence, Crepinsek requires preselection of a distance prior to installation.

U.S. Pat. No. 4,359,886 issued to Evans et al. ("Evans"), relates to cylinder type key locks and locking devices that are environmentally exposed. It discloses a key mortise cylinder for possibly contaminated environments. The mortise cylinder is a key operated rotary core cylinder lock having rotary disc tumblers arranged in a pack with intervening spacers inside of a rotary core sleeve which is held against rotation within the lock casing by a locking bar.

U.S. Pat. No. 4,196,605 issued to Garza ("Garza"), relates to improvements in tumbler pin-type cylinder locks provided with safety means to reduce the chances that the lock can be picked or rendered ineffective. It discloses a tumbler pin-type cylinder lock with axial or axial and radial cylinder movement. The cylinder moves axially or axially and radially with respect to the lock housing. Movement of the mortise cylinder in the axial direction is brought about by spring means—a helical compression spring constantly urges the cylinder towards the front end of the lock housing, and upon insertion the appropriate key moves the cylinder against the urging of the spring.

U.S. Pat. No. 4,077,240 issued to Crasnianski ("Crasnianski"), discloses a cylinder lock of the type having a stator with a rotor and lamellae actuated by a flat key. The rotor comprises floating lamellae capable of moving radially and angularly, and means for guiding the flat key over its entire introduction path into the rotor without any possibility of lateral or radial displacement. The lamellae are released as a result of the axial pressure applied to the rotor by the key against the action of a spring.

U.S. Pat. No. 3,724,244 issued to Schaumburg ("Schaumburg"), discloses a lock actuated anti-theft device mainly for automobiles. A system of rollers is provided in the direct vicinity of the key hole portion of the lock. Operation of the key causes internal shifting of the rollers causing other lock portions to go into locking position, where the locking position is fully established upon total removal of the key from the lock.

U.S. Pat. No. 3,382,688 issued to Wellekens ("Wellekens"), discloses a lock for vending machines or the like. The lock consists of a plurality of concentric sleeves in nested relationship, where the outermost sleeve constitutes a lock casing, the innermost sleeve carries a locking mechanism that controls a latch, the intermediate sleeve is coupled to the inner sleeve by a rotatable cup having a shoulder under which the latch is advanced for the sleeves to be completed nested. A spring advances the joined inner and intermediate sleeves partly out of the outermost sleeve when the latch is disengaged.

U.S. Pat. No. 3,089,329 issued to Kerr ("Kerr"), discloses an alarm assembly for a refrigerated cabinet or the like. It consists of a draw alarm assembly having a nestled handle and a connecting cam between the handle and a draw shaft. This connection allows for a positive drive between the handle and draw shaft during door tightening operations, but permits for a limited degree of reverse movement of the handle after the tightening operation has been completed.

U.S. Pat. No. 3,026,385 issued to Davis, et al. ("Davis"), relates to an improved push-button operator with locking means. It discloses a push-button operating mechanism comprising a tubular casing, a push-button mounted in the casing for reciprocal movement, a lock barrel mounted in the outer end of the push-button and rotatable upon insertion of appropriate key. The lock barrel is rotatable to one position when the push-button is in its outwardly extended position, and it is rotatable to another position when the push-button is depressed inwardly. A torsion spring urges the lock barrel to rotate upon insertion of the key in and and causes the change from a depressed to an extended position of the push-button.

Even with the numerous attempts to improve locks, there remain a number of shortcomings with these attempts. Accordingly, a need exists for alarm and lock assemblies using a conventional mortise cylinder with a tailpiece on its distal end that minimizes the number of parts in the assembly and simplifies installation on a door or wall.

SUMMARY OF THE INVENTION

It is a general object of the present invention to provide an alarm or lock assembly that is adapted for easy assembly and reliable performance. This and other objects of the invention are achieved by providing a mortise cylinder having a rotatable center. The rotatable center has an exterior end and an interior end. The exterior end receives a key for operations or may have a knob. The interior end has a tailpiece and is rotatable coincident with rotation of the key or knob on the exterior end. A cam engages the tailpiece on the mortise cylinder to provide selective movement of the cam responsive to rotation of the key cylinder in the mortise cylinder.

A housing secures the mortise cylinder and cam relative to one another and to a door or wall. A biasing member is disposed between the housing and cam for urging the cam into secure engagement with the tailpiece of the mortise cylinder, wherein variation in the distance between the cam and the tailpiece on the interior end of the mortise cylinder can be accommodated.

According to a preferred embodiment of the present invention, the housing further comprises a plate that is securable to a wall or door and has the mortise cylinder extending therethrough, and a bracket secured to the plate and carrying the cam for rotation.

According to a preferred embodiment of the present invention, the biasing member is a coil spring disposed between a portion of the bracket and the cam.

According to a preferred embodiment of the present invention, the bracket comprises a pair of opposed, generally parallel surfaces, one of which has an aperture to receive a portion of the mortise cylinder. The cam is disposed between the surfaces. The coil spring is disposed between the cam and the surface opposite the surface having an aperture.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE PREFERRED EMBODIMENTS

In the following discussion, numerous specific details are set forth to provide a thorough understanding of the present invention. However, it will be obvious to those skilled in the art that the present invention may be practiced without such specific details. In other instances, well-known elements have been illustrated in block diagram form in order not to obscure the present invention in unnecessary detail.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
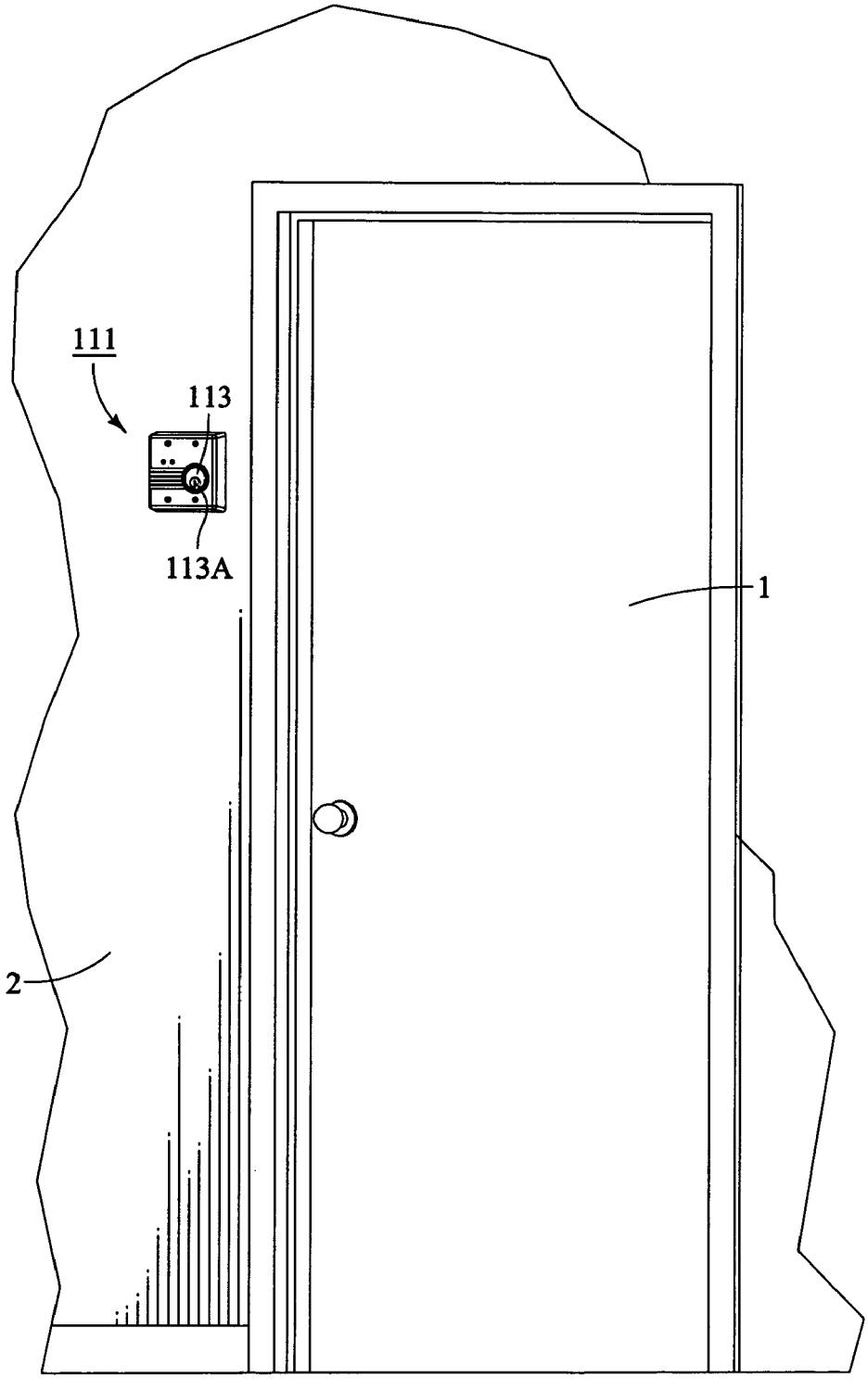
FIG. 1 is an elevation view of a door incorporating an alarm assembly according to a preferred embodiment of the present invention.

FIG. 1 of the drawings is an elevation view of a door incorporating an alarm assembly according to a preferred embodiment of the present invention. As seen in FIG. 1, reference numeral 1 designates a door. Door 1 is hinge-attached to wall 2. Alarm assembly 111 is secured to wall 2, allowing door 1 to have an alarm armed by inserting and rotating the proper key in key cylinder 113A of mortise cylinder 113.

Figure 2:
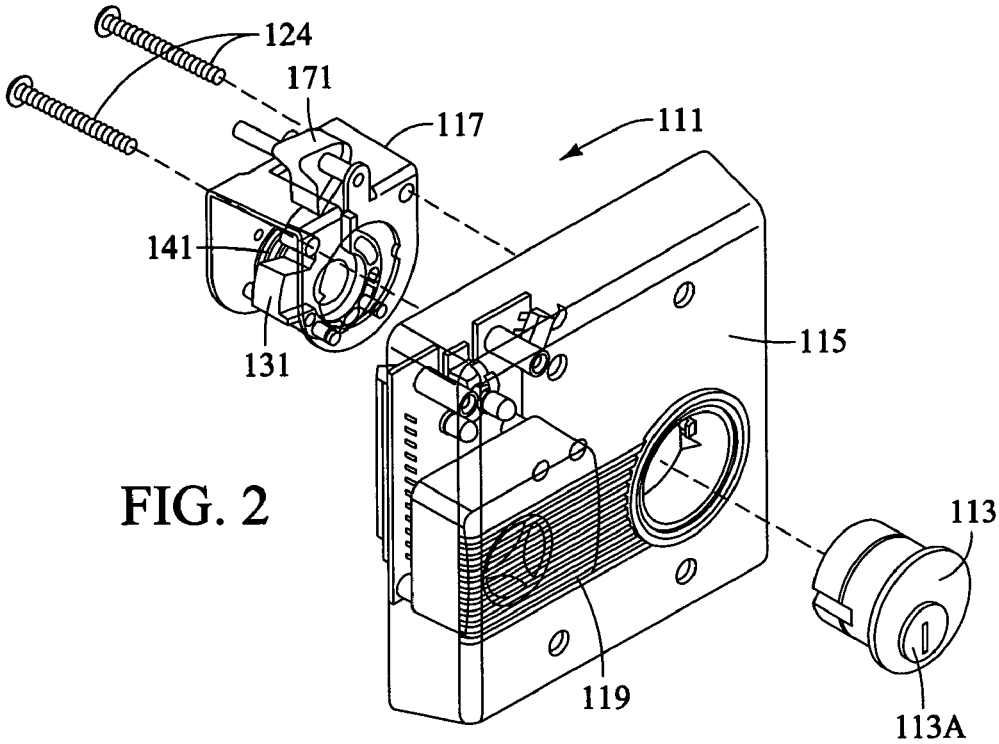
FIG. 2 is an exploded perspective view, partially in section, of the alarm assembly of FIG. 1.
Figure 3:
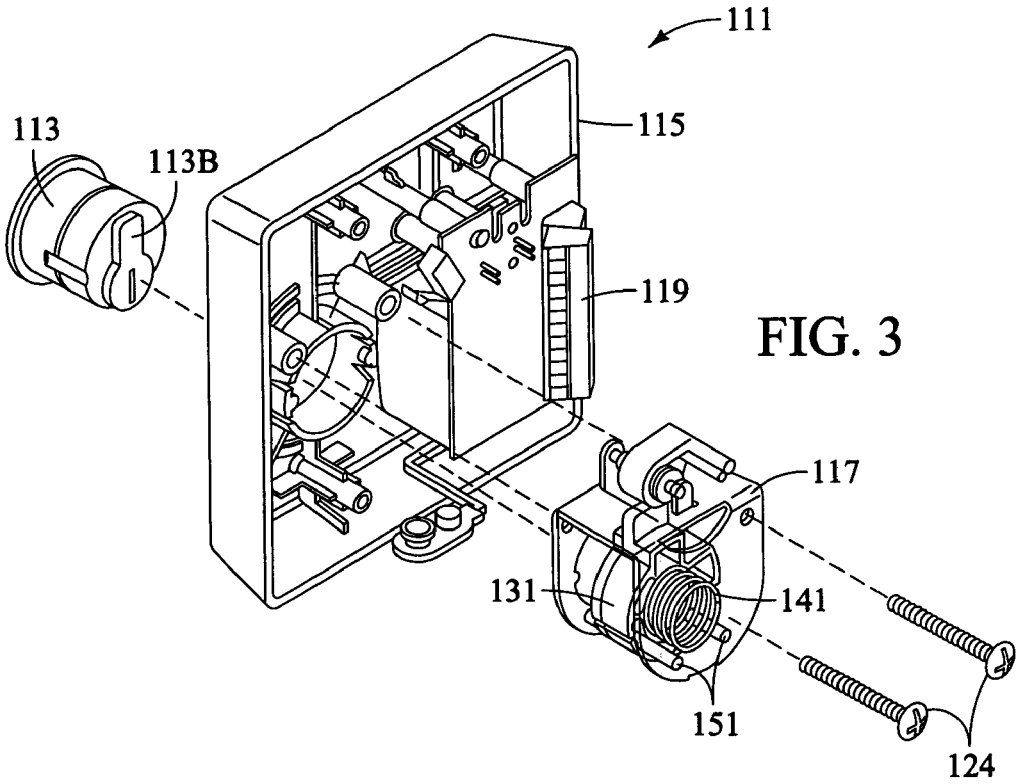
FIG. 3 is an exploded perspective view, partially in section, of the alarm assembly of FIG. 1, shown in reverse.

As can be seen in the exploded views of FIGS. 2 and 3, alarm assembly 111 comprises, in part, a mortise cylinder 113, a cover or plate 115, an alarm siren 119, a bracket 117, a cam 131, and a coil spring 141. Cover 115 is equipped to couple to wall 2, as shown in FIG. 1, and is equipped to retain the alarm siren 119, and mortise cylinder 113. Alarm siren 119 may comprise an audible alarm, a silent alarm, lighting, video activation, or other electronic activated emergency function or a combination of thereof. Bracket 117 is secured against mortise cylinder 113 by screws 124.

As can also be seen in FIGS. 2 and 3, mortise cylinder 113 is a generally conventional lock cylinder, further comprising a key cylinder 113A operably rotatable when the correct key is installed. Key cylinder 113A extends through the length of mortise cylinder 113, exiting the internal end in the form of a tailpiece 113B. Oftentimes, tailpiece 113B is referred to as a "bowling pin" because of its shape. Functionally, tailpiece 113B is a cam surface which rotates in common with rotation of the key or knob which rotates key cylinder 113A of mortise cylinder 113. When fully assembled, tailpiece 113B is operatively located in bracket 117.

Now referring to FIGS. 4, 5, 6, and 7, perspective views of a portion of alarm assembly 111 of FIGS. 2 and 3 can be seen in accordance with a preferred embodiment of the present invention. Bracket 117 retains cam 131, coil spring 141, and sensor trigger 171. Optionally, a second cam 161 is attachable to the backside of bracket 117. Specifically, cam 131 is rotationally disposed within bracket 117 and is biased against coil spring 141. The combination of cam 131 and coil spring 141 are secured by pins 151 that couple to bracket 117. Second cam 161 is also secured to cam 131 for common rotation. Additionally, sensor trigger 171 is located on the upper surface of bracket 117.

Figure 8A:
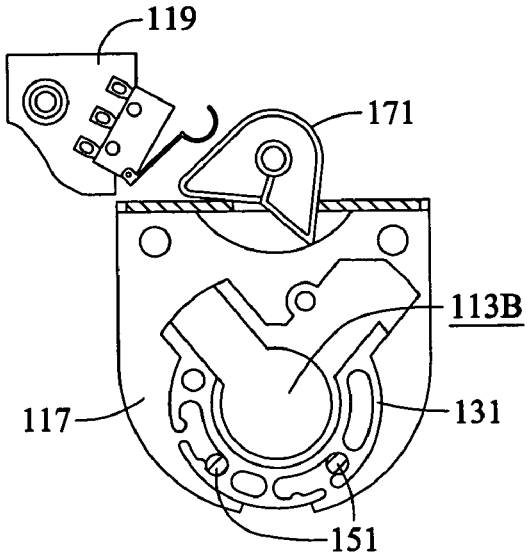
FIGS. 8A, 8B and 8C are elevation views, partially in section, illustrating the operation of the alarm assembly according to a preferred embodiment of the present invention.
Figure 8B:
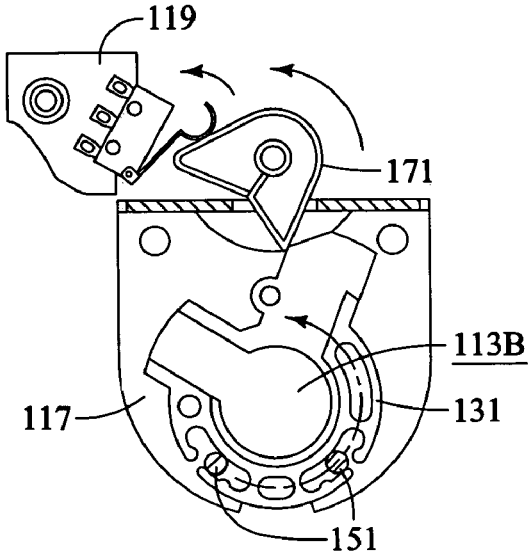
Figure 8C:
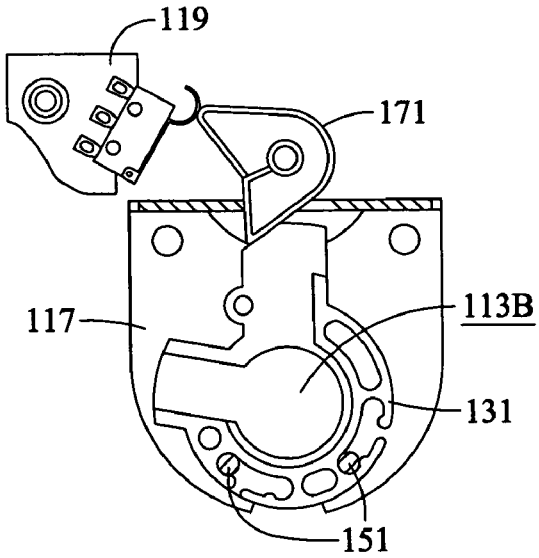

Referring to FIGS. 8A, 8B, and 8C, elevation views, partially in section, illustrate the operation of alarm assembly 111 according to a preferred embodiment of the present invention. Rotating key cylinder 113A of mortise cylinder 113 rotates tailpiece 113B. Tailpiece 113B engages cam 131, which rotates about pins 151. The periphery of cam 131 selectively engages sensor trigger 171, thereby arming, or disarming alarm siren 119.

FIG. 8A shows alarm assembly 111 in a disengaged position. FIG. 8B shows alarm assembly 111, in an intermediate position, still unarmed, in which sensor trigger 171 is initially contacted by cam 131. FIG. 8C shows alarm assembly 111 in an armed position, in which cam 131 has fully engaged sensor trigger 171, which has in turn armed alarm siren 119. As shown, detents are formed in the ends of the slots through which pins 151 extend to provide positive indication of the position of tailpiece 113B.

OPERATION OF THE PREFERRED EMBODIMENTS

Referring now to the Figures, in particularly to FIG. 1, an elevation view of a door 1 incorporating an alarm assembly 111 mounted to a wall 2 according to the present invention is illustrated. The only portions of alarm assembly 111 visible in FIG. 1 are the proximal or exterior end of key cylinder 113A of mortise cylinder 113 and cover or plate 115.

Plate 115 is both part of the structure of alarm assembly 111 according to a preferred embodiment of the present invention and also serves a "cosmetic" purpose in that it covers door 1 or wall 2 to which alarm assembly 111 is installed. Alarm assembly 111 according to the present invention has utility in connection with conventional door locks, exit control locks, exit alarms, panic devices, and the like where conventional mortise cylinders (keyed or otherwise) are used.

With reference to FIGS. 2 and 3, exploded front and rear perspective views, partially in section, of alarm assembly 111, without wall 2, are illustrated. As previously mentioned, alarm assembly 111 comprises a conventional mortise cylinder 113, which is secured in an aperture in a cover or plate 115. In the embodiment illustrated, by way of example only, alarm assembly 111 is used in connection with an alarm in which keyed cylinder 113 is used to activate an alarm sensor. Although the term "cylinder" is used, and the majority of mortise cylinders are cylindrical, the cylinder according to the present invention need not be cylindrical in configuration. Similarly, while a keyed mortise cylinder (operated with a key) is illustrated, the present invention has utility with deadbolts and non-keyed lock assemblies.

A bracket 117 is secured to the reverse side of cover plate 115 and also to mortise cylinder 113. According to a preferred embodiment of the present invention, mortise cylinder 113 is secured to plate 115 in accordance with commonly assigned, co-pending U.S. patent application entitled "Retaining Mechanism for Mortise Cylinders," filed concurrently herewith, which claims priority to U.S. Provisional Patent Application No. 60/560,651, filed on Apr. 8, 2004. Alternatively, mortise cylinder 113 may be secured to plate 115 by use of a conventional hexagonal nut (not shown).

Mortise cylinder 113 has a proximal or exterior end, which protrudes from plate 115 and is the end through which a key is inserted into key cylinder 113A. Mortise cylinder 113 has a tailpiece 113B, formed on the distal or interior end. Tailpiece 113B engages a complementary surface on a cam 131, which is held in place relative to mortise cylinder 113 by a bracket 117 and a coil spring 141. Bracket 117 and plate 115 cooperate to define a housing for alarm assembly 111 according to the present invention.

According to a preferred embodiment of the present invention, bracket 117 is in an inverted U-shape with two parallel, generally opposed plates or surfaces, one of which has an aperture dimensioned to receive the end of mortise cylinder 113. Bracket 117 is secured to plate 115 by a pair of screws 124 and secures cam 131 for rotation with key cylinder 113A of mortise cylinder 113. As shown in FIGS. 8A through 8C, cam 131 receivably engages tailpiece 113B.

Figure 4:
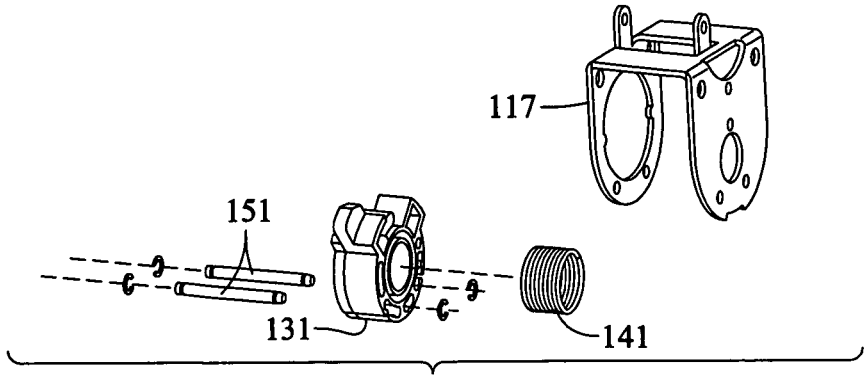
FIG. 4 is an exploded perspective view of a portion of the alarm assembly illustrated in FIGS. 2 and 3.

As shown in the exploded view of FIG. 4, coil spring 141 or other biasing member 141 is disposed within bracket 117 and in engagement with cam 131. By acting between the rearward portion (relative to plate 115) of bracket 117 and cam 131, cam 131 is urged forward (again relative to plate 115) and into engagement with tailpiece 113B of mortise cylinder 113. Spring 141 or biasing member 141 thus "takes up" any tolerance or "slop" in the distance between tailpiece 113B and the corresponding surface of cam 131. This avoids the need for careful fitting, adjustment, and shimming of alarm assembly 111 according to a preferred embodiment of the present invention. A pair of pins 151 secure cam 131 for rotation within bracket 117. In the preferred embodiment, spring 141 is also confined within a circular recess in cam 131 so that it is captured between cam 131 and the rearward portion of bracket 117 after assembly.

Figure 5:
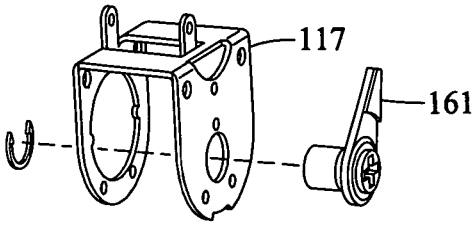
FIG. 5 is an exploded view of another portion of the alarm assembly of FIGS. 2 and 3.
Figure 6:
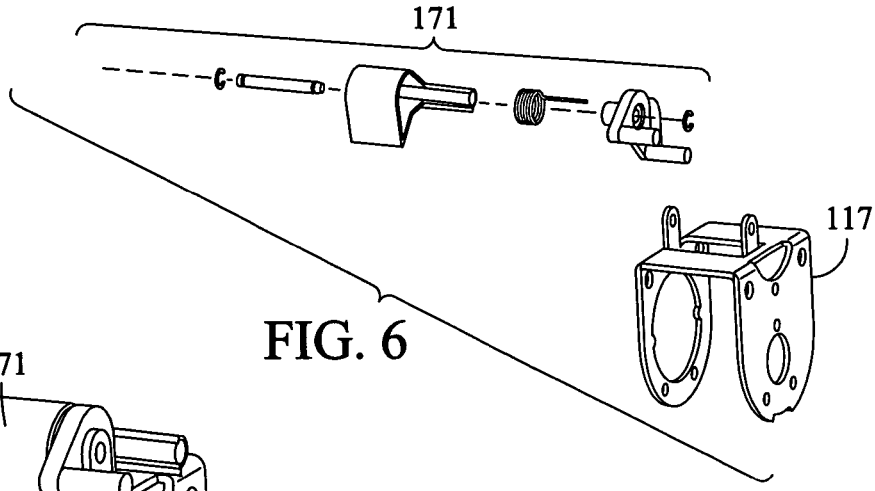
FIG. 6 is an exploded view of another portion of the alarm assembly of FIGS. 2 and 3.

FIGS. 5 and 6 illustrate other components of bracket assembly 117 that are not intended to be considered part of the present invention, but merely environment. An optional second cam 161 may be secured to the rear plate of bracket and partially actuates a sensor trigger or cam assembly 171. Second cam 161 may be engaged with a secondary lock or latch mechanism for arming and disarming alarm 119 from the other side of door 1 and wall 2. Again, alarm assembly 111 according to the present invention has utility with both alarm systems (as shown) and conventional bolt locks; alarm siren 119 is depicted for illustrative purposes of the preferred embodiment only.

Figure 7:
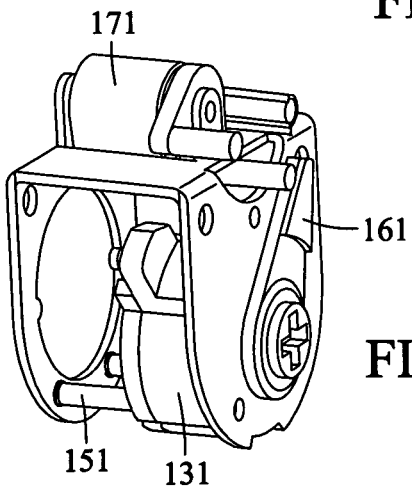
FIG. 7 is an assembled view of the portion of the alarm assembly of FIGS. 2 through 6.

FIG. 7 depicts bracket 117 fully assembled with cam 131 and spring 141 disposed therein and secured by pins 151. Spring 141 is obscured from view in FIG. 7. Second cam 161 and sensor trigger 171 are also illustrated assembled together with bracket 117.

FIGS. 8A, 8B, and 8C depict alarm assembly 111 according to a preferred embodiment of the present invention in operation. Key cylinder 113A represents the internal locking mechanism of mortise cylinder 113. Key cylinder 113A is rotated by action of the proper key or by action of a knob, which rotates tailpiece 113B. Coil spring 141 is compressively located between one side of bracket 117 and cam 131. Cam 131 is thus biased against the opposite side of bracket 117 in the direction of plate 115. The biasing of cam 131 locates cam 131 in desirable positional relationship with tailpiece 113B of mortise cylinder 113.

Tailpiece 113B engages one side or the other (only one side corresponding to clockwise rotation of the key or bolt is illustrated) of cam 131, which rotates (with cylinder 113) about pins 151. The periphery of cam 131 selectively engages sensor trigger 171 and moves it into and out of registry, or contact, with a switch portion of alarm siren 119, thereby arming, or disarming, alarm siren 119. FIG. 8A shows alarm assembly 111 in a disengage position. FIG. 8B shows alarm assembly 111 in an intermediate position in which sensor trigger 171 is initially engaged by cam 131.

FIG. 8C shows alarm assembly 111 in a fully engaged position in which cam 131 has fully engaged sensor trigger 171, which has armed (or disarmed) alarm siren 119. As visible on FIG. 8C, small detents, or tabs, are formed in the ends of the slots through which pins 151 extend to provide positive indication of the keyed position of mortise cylinder 113, maintaining the armed status of alarm siren 119.

Alarm assembly 111 according to the present invention has a principal advantage over the prior art in that it is assembled with less adjustment and greater reliability than conventional alarm and lock assemblies. Incorporating conventional and readily available mortise cylinders 113 into alarm assemblies 111 requires secure and reliable engagement between tailpiece 113B and cam 131.

Since tailpiece 113B does not extend outwardly substantially far from traditional mortise cylinders 113, providing secure and reliable engagement in compact alarm assemblies 111 typically requires delicate and experienced assembly and the use of spacing shims. The biasing action of spring 141 insures positive engagement between tailpiece 113B and cam 131, regardless of minor variations in the assembled distance between them.

The invention has been described with reference to preferred embodiments thereof, it is thus not limited, but susceptible to variation and modification without departing from the scope and spirit of the invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

We claim:

1. A lock assembly comprising:

a mortise cylinder having a rotatable center, the rotatable center having an exterior end and an opposite interior end;

a tailpiece on the interior end;

a cam for engagement with the tailpiece to provide selective movement of the cam responsive to rotation of the mortise cylinder;

a housing securing the mortise cylinder and cam relative to one another; and, a biasing member disposed between the housing and cam for urging the cam into engagement with the tailpiece, wherein variation in a distance between the cam and tailpiece can be accommodated.

2. The lock assembly according to claim 1, wherein the housing further comprises:

a plate securable to a wall or door and having the mortise cylinder extending therethrough; and, a bracket secured to the plate and carrying the cam for rotation, wherein the biasing member is a coil spring disposed between a portion of the bracket and the cam.

3. The lock assembly according to claim 2, wherein the bracket comprises a pair of opposed, generally parallel surfaces, one of which has an aperture to receive a portion of the mortise cylinder, the cam being disposed between the surfaces, and the coil spring is disposed between the cam and the surface opposite the surface having an aperture.

4. The lock assembly according to claim 1, wherein the cam actuates a sensor trigger of an alarm system in response to rotation of the mortise cylinder.

5. The lock assembly according to claim 1, wherein the biasing member is partially confined within a circular recess in the cam.

6. A lock assembly comprising:

a mortise cylinder having a rotatable center having an exterior end and an opposite interior end;

a tailpiece on the interior end;

a plate for receiving the interior end of the mortise cylinder and through which the exterior end extends;

a bracket securing the mortise cylinder relative to the plate while permitting the mortise center to rotate relative to the plate;

a cam carried by the bracket for engagement with the tailpiece to provide selective movement of the cam responsive to rotation of the mortise center; and, a biasing member disposed between the bracket and cam for urging the cam into engagement with the tailpiece, wherein variation in a distance between the cam and tailpiece can be accommodated.

7. The lock assembly according to claim 6, wherein the bracket comprises a pair of opposed, generally parallel surfaces, one of which has an aperture to receive a portion of the mortise cylinder, the cam being disposed between the surfaces, and the coil spring is disposed between the cam and the surface opposite the surface having an aperture.

8. The lock assembly according to claim 6, wherein the cam actuates a sensor trigger of an alarm system in response to rotation of the mortise cylinder.

9. A keyed locking assembly comprising:

a lock cylinder having an exterior end and an interior end having a cylinder cam surface, the lock cylinder being rotatable about an axis;

a cam for engagement with the cylinder cam surface on the lock cylinder to provide selective movement of the cam responsive to rotation of the lock cylinder;

a housing securing the lock cylinder and cam relative to one another and to a door; and a biasing member disposed between the housing and cam for urging the cam into engagement with the cylinder cam surface, wherein variation in a distance between the cam and cylinder cam surface can be accommodated.

10. The keyed locking assembly according to claim 9, wherein the housing further comprises:

a plate secured to the door and having the lock cylinder extending therethrough;

a bracket secured to the plate and carrying the cam for rotation, wherein the biasing member is a coil spring disposed between a portion of the bracket and the cam.

11. The keyed locking assembly according to claim 10, wherein the bracket comprises a pair of opposed, generally parallel surfaces, one of which has an aperture to receive a portion of the lock cylinder, the cam being disposed between the surfaces, and the coil spring is disposed between the cam and the surface opposite the surface having an aperture.

12. The keyed locking assembly according to claim 9, wherein the cam actuates a sensor trigger of an alarm system in response to rotation of the lock cylinder.

* * * * *